US010500846B1

(12) United States Patent
Knierim

(10) Patent No.: US 10,500,846 B1
(45) Date of Patent: Dec. 10, 2019

(54) PRINT HEAD WITH INTEGRATED JET IMPEDANCE MEASUREMENT

(71) Applicant: XEROX CORPORATION, Norwalk, CT (US)

(72) Inventor: David L. Knierim, Wilsonville, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 16/104,717

(22) Filed: Aug. 17, 2018

(51) Int. Cl.
*B41J 2/045* (2006.01)

(52) U.S. Cl.
CPC ..... *B41J 2/04541* (2013.01); *B41J 2/0455* (2013.01); *B41J 2/04555* (2013.01); *B41J 2/04581* (2013.01)

(58) Field of Classification Search
CPC ..... B41J 2/04541; B41J 2/04555; B41J 2/04581; B41J 2/0455
See application file for complete search history.

(56) References Cited

U.S. PATENT DOCUMENTS

| | | | | |
|---|---|---|---|---|
| 6,812,621 | B2 | 11/2004 | Scott | |
| 9,022,515 | B2 | 5/2015 | Ready et al. | |
| 9,457,560 | B2 | 10/2016 | Ready et al. | |
| 2002/0089562 | A1* | 7/2002 | Simons | B41J 2/0451 347/19 |
| 2008/0030102 | A1* | 2/2008 | Ohnishi | B41J 2/0451 310/317 |
| 2018/0086058 | A1* | 3/2018 | Abe | B41J 2/04541 |

* cited by examiner

*Primary Examiner* — Yaovi M Ameh
(74) *Attorney, Agent, or Firm* — Miller Nash Graham & Dunn LLP

(57) ABSTRACT

A print head, including a plurality of piezoelectric actuators, a pseudo-actuator, a drive rail, electronic selection circuitry connected to each of the plurality of piezoelectric actuators, the pseudo-actuator, and the drive rail, the electronic selection circuitry configured to select at least one of the piezoelectric actuators or the pseudo-actuator to connect to the drive rail, and a controller coupled to the drive rail, the controller configured to generate a waveform to drive the drive rail and measure a signal on the drive rail connected to a piezoelectric actuator, a pseudo-actuator, or without any connected piezoelectric actuators or the pseudo-actuator, and using the resulting measurements to calculate an impedance of a piezoelectric actuator.

19 Claims, 3 Drawing Sheets

PRINT HEAD WITH INTEGRATED JET IMPEDANCE MEASUREMENT

TECHNICAL FIELD

This disclosure relates to testing print heads, and in particular, to internally measuring an impedance of piezoelectric actuators of a print head.

BACKGROUND

Piezoelectric ink jet print heads have many features and failure mechanisms that may be characterized or diagnosed by measuring an impedance of a piezoelectric actuator of the print head over a sweep of frequencies. For example, an impedance measurement of a piezoelectric actuator of the print head may show issues with electrical connectivity, mechanical and fluidic resonances of individual ink jets, and crosstalk between neighboring ink jets of the print head.

Conventionally, ink jet impedance sweep measurements are taken with a commercial impedance meter wired to one jet at time, making it impractical to run an impedance sweep measurement on all the ink jets of a print head, due to the time constraints of constantly rewiring the impedance meter to each jet.

Embodiments of the disclosure address these and other deficiencies in the prior art.

SUMMARY

One embodiment of the disclosure herein includes a print head, including a plurality of piezoelectric actuators, a pseudo-actuator, a drive rail, electronic selection circuitry connected to each of the plurality of piezoelectric actuators, the pseudo-actuator, and the drive rail, the electronic selection circuitry configured to select at least one of the piezoelectric actuators or the pseudo-actuator to connect to the drive rail, and a controller coupled to the drive rail, the controller configured to generate a waveform to drive the drive rail and measure a signal on the drive rail connected to a piezoelectric actuator, a pseudo-actuator, or without any connected piezoelectric actuators or the pseudo-actuator, and using the resulting measurements to calculate an impedance of a piezoelectric actuator.

Another embodiment of the disclosure herein includes a method for measuring an impedance of each of a plurality of piezoelectric actuators of a print head, each piezoelectric actuator connected to electronic selection circuitry of the print head that drives the piezoelectric actuators during a print operation, comprising generating a digital waveform at a controller to drive a drive rail of the print head. The drive rail is connected to the electronic circuitry of the print head. The method also includes converting the digital waveform to an analog waveform to drive the drive rail, connecting a pseudo-actuator to the drive-rail through the electronic selection circuitry, and determining an impedance of the pseudo-actuator based on the analog waveform to drive the drive rail to determine a reference impedance. One of the piezoelectric actuators is connected to the drive-rail through the electronic selection circuitry, and an impedance of each of the piezoelectric actuators is determined based on the reference impedance.

DETAILED DESCRIPTION OF THE EMBODIMENTS

Piezoelectric ink jet print heads generally use one or two waveform drive rails to which individual ink jets are connected, generally through electronic selection circuitry, such as an application specific integrated circuit (ASIC), to fire ink drops towards a print medium. For the two-rail case, positive portions of waveforms are on a VPP drive rail while negative portions of the waveforms are on a VSS drive rail. A base capacitance on each of the drive rails, with no ink jets connected, is approximately 50 nF to 70 nF. Connecting one ink jet to a drive rail may add, for example, 55 pF additional capacitance, or a roughly 0.1% increase in capacitance.

A print head of embodiments herein internally measures an impedance of the piezoelectric actuators for each individual ink jet by measuring the additional capacitance of the piezoelectric actuator when connected to a drive rail and comparing it to a reference capacitance to determine the impedance and/or capacitance of each individual ink jet. The additional capacitance may be measured on either the VSS drive rail or the VPP drive rail. In embodiments discussed below, the VPP drive rail is used for the measurements, but one of ordinary skill in the art would recognize the ability to do such measurements on the VSS drive rail as well, or on a single drive rail for print heads implementing only one waveform rail. Embodiments described herein are advantageous by not needing any additional cables or instruments to measure the impedance of the individual ink jets—rather, the measurements may all be done internally to the print heat.

Figure 1:
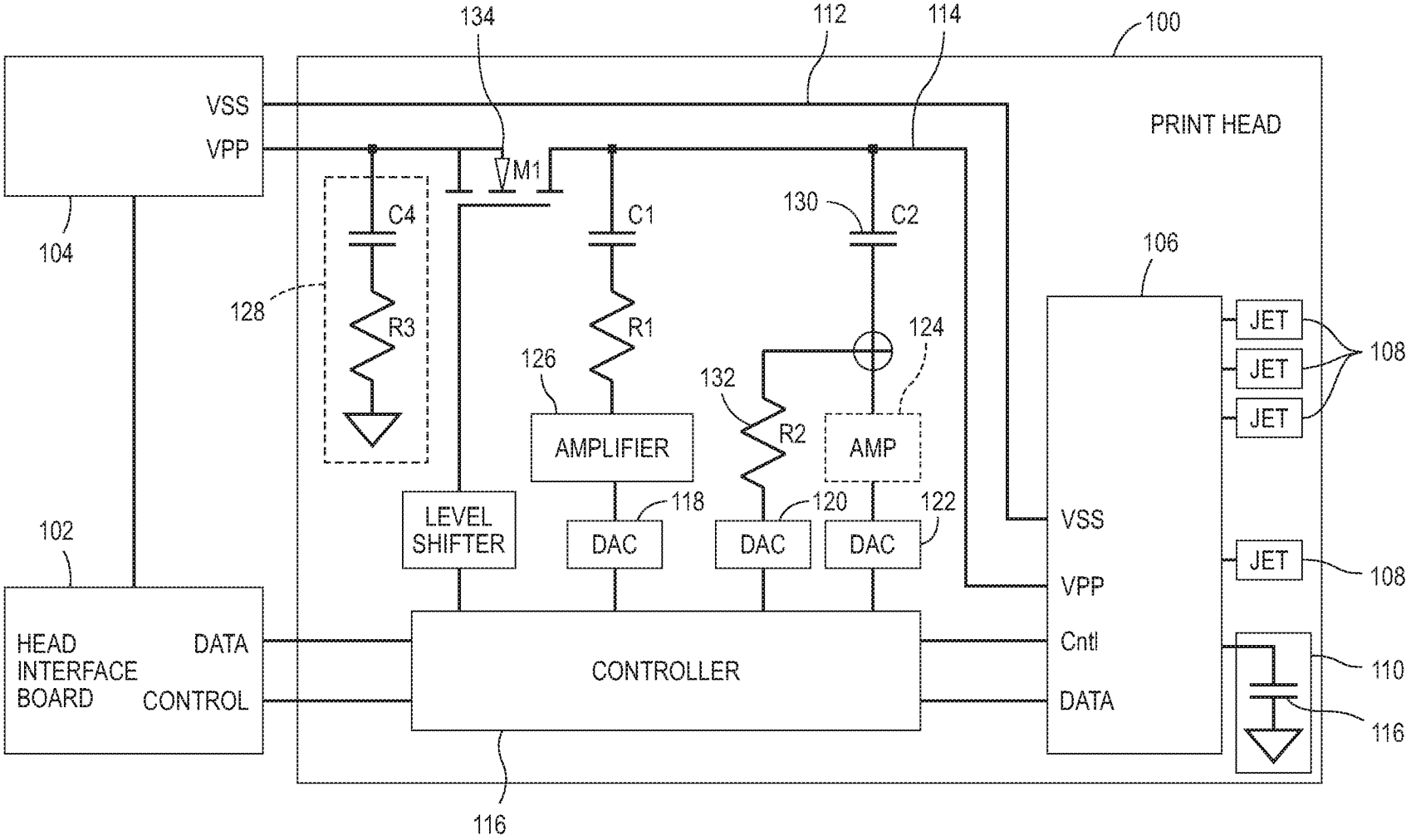
FIG. 1 illustrates a block circuitry diagram of a print head according to some embodiments of the disclosure.

FIG. 1 illustrates an example circuitry block diagram of a print head 100 according to some embodiments of the disclosure. As will be understood by one skilled in the art, the print head may include additional components not discussed in detail herein.

Print head 100 typically connects to external electronics, such as a print head interface 102 electronically connected to a signal source 104. The external electronics provide image data to the print head 100, along with waveform rails and associated timing and control signals. The print head 100 includes electronic selection circuitry 106 which can select a piezoelectric actuator of an individual ink jet 108 or a pseudo-actuator 110 to connect to a VSS drive rail 112 and the VPP drive rail 114. The pseudo-actuator 110, which also may be referred to herein as a dummy jet, may include, for example, a capacitor 116. During a normal print operation, the print head interface 102 may instruct the signal source 104 to provide a waveform to the VSS drive rail 112 and the VPP drive rail 114 to drive the connected piezoelectric actuators of the various individual ink jets 108 to eject ink toward a print medium.

The print head 100 also includes a controller 116, such as a field programmable gate array (FPGA), receiving image data and timing signals from the print head interface 102, and electronically connected to the electronic selection circuitry 106. The controller 116 can instruct the electronic selection circuitry 106 to connect either the various individual ink jets 108 or pseudo-actuator 110 to the drive rails 112 and 114, either for a print operation or for an impedance measurement, as will be discussed in more detail below.

As mentioned above, the print head 100 is able to internally perform an impedance measurement for each of the piezoelectric actuators of each of the individual ink jets 108 over a sweep of frequencies to characterize jets and/or diagnose any issues with the jets. During an impedance measurement, the controller 116 sends instructions to the electronic selection circuitry 106 to connect a particular piezoelectric actuator of an individual jet 108, a pseudo-actuator 110, or no actuators (piezoelectric or pseudo) to the drive rails 112 and 116 to perform an impedance measurement. As mentioned below, the pseudo-actuator 110 provides a reference capacitance for determining an impedance of each of the piezoelectric actuators of the individual jets 108 and no connected jets 108 or pseudo-actuators 110 provides a baseline reading.

The controller 116 outputs a digital signal to a digital-to-analog converter (DAC) 118 which converts the digital signal to an analog waveform, such as a sine wave at a particular frequency. Another digital signal is output to a DAC 120, such that the sine wave at DAC 120 is the same frequency as the sine wave at DAC 118. Capacitor C2 130 and resistor R2 132 function to combine the sine wave from DAC 120 with the signal on the VPP drive rail 114 to form the input to the analog-to-digital converter (ADC) 122 used to measure the impedance on the VPP drive rail 114. The sine wave at DAC 120 is shifted in phase and amplitude to minimize the ADC signal when none of the piezoelectric actuators of the individual jets 108 or pseudo-actuators 110 are connected to the drive rail 114.

In some embodiments, an optional amplifier 124 may be located before the ADC 122 to amplify the signal received at the ADC 122 prior to the measurement. An amplifier 126 may also amplify an analog signal from the DAC 118. During normal printing, a field effect transistor (FET) M1 connects the external VPP waveform rail from signal source 104 to the head's internal VPP waveform rail 114. During impedance testing, the controller 116 turns off FET M1 134, disconnecting the VPP waveform rail 114 from the external signal source. This allows VPP to be driven by DAC 118 through amplifier 126. As will be understood by one skilled in the art, the print head 100 may also include various other components not discussed in further detail herein, such as a VPP base load 128, various resistors and capacitors, as well as various other components not shown in FIG. 1.

Figure 2:
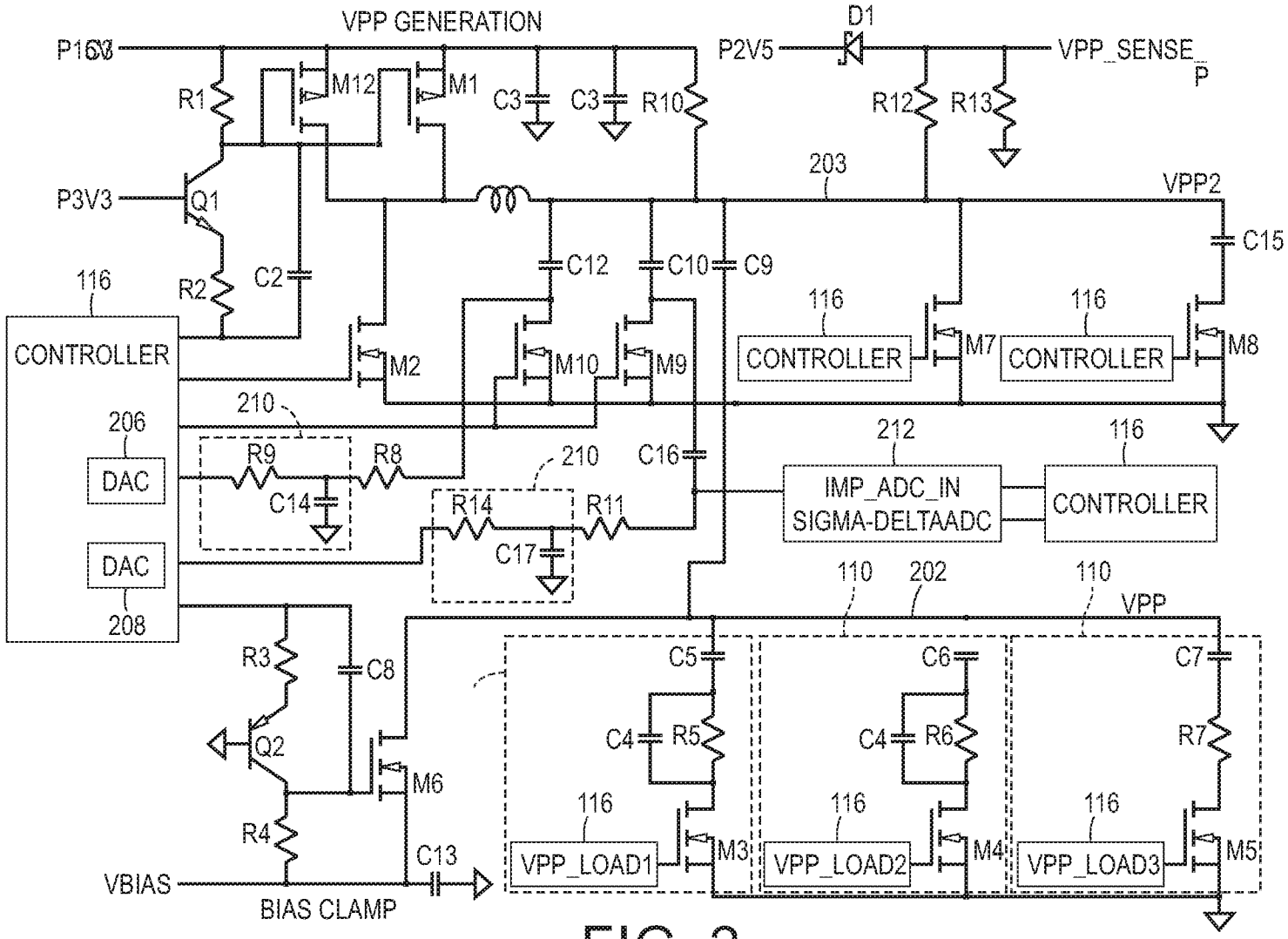
FIG. 2 illustrates a block circuitry diagram of a print head according to other embodiments of the disclosure.

FIG. 2 illustrates another example print head 200 that internally performs an impedance measurement of the piezoelectric actuators of individual jets 108 and pseudo-actuators 110. Print head 200, as will be understood by one skilled in the art, includes a number of FETs, capacitors, and resistors, that will not be discussed further herein. For ease of illustration of the print head 200, a number of the controller 116 inputs and outputs are shown separated. However, as will be understood by one skilled in the art, each of these inputs and/or outputs may be located on a single controller 116.

Similar to print head 100, the print head 200 may include electronic selection circuitry 106 (not shown in FIG. 2) to connect a particular piezoelectric actuator 108, a pseudo-actuator 110, or no actuators (piezoelectric or pseudo) to the drive rail 202. The print head 200 may also include another drive rail 203, which is coupled to the drive rail 202 through a capacitor C9. For AC-based measurements, the rails are equivalent. However, the drive rails 202 and 203 do have a DC offset bias between them. In this embodiment, simple sigma-delta DACs 206 and 208 may be located in the controller 116, and low-pass filters 210, consisting of resistors and capacitors, as will be understood by one skilled in the art, may be used to filter the output of the DACs 206 and 208. In some embodiments, however, the DACs 206 and 208 may be located separate from the controller 116 and may include the low-pass filters 210.

Similar to print head 100, DAC 206 outputs a waveform, such as a sine wave, at a particular frequency to the drive rail 202. A waveform from DAC 208 is output that is the same frequency as the waveform from DAC 206, but shifted in amplitude and phase to be summed into the signal from the drive rail 202 to a sigma-delta ADC 212. Although not shown in FIG. 2, the sigma-delta ADC 212 may also include a low pass filter to filter the incoming signal. The sigma-delta ADC 212 outputs a digital signal to the controller 116 to determine the impedance of each of the piezoelectric actuators 108.

In print head 200, all of the FETs shown in FIG. 2 are disabled during an impedance measurement period, then set back to their normal quiescent states, which is all but M1 and M12 enabled, between each measurement.

In some embodiments, synchronous rectification of the signal into the ADC 212 may be implemented. In such an embodiment, two synchronous rectifiers are used, each driven at the frequency sent to the VPP drive rail 114 or 202, one with a 90 degree phase shift. Then, two ADCs 210 may be used, one for each rectifier. This may lower the noise level when using the sigma-delta ADCs, which may allow the sigma-delta ADCs to function even for large print heads, such as shown in FIG. 1.

Figure 3:
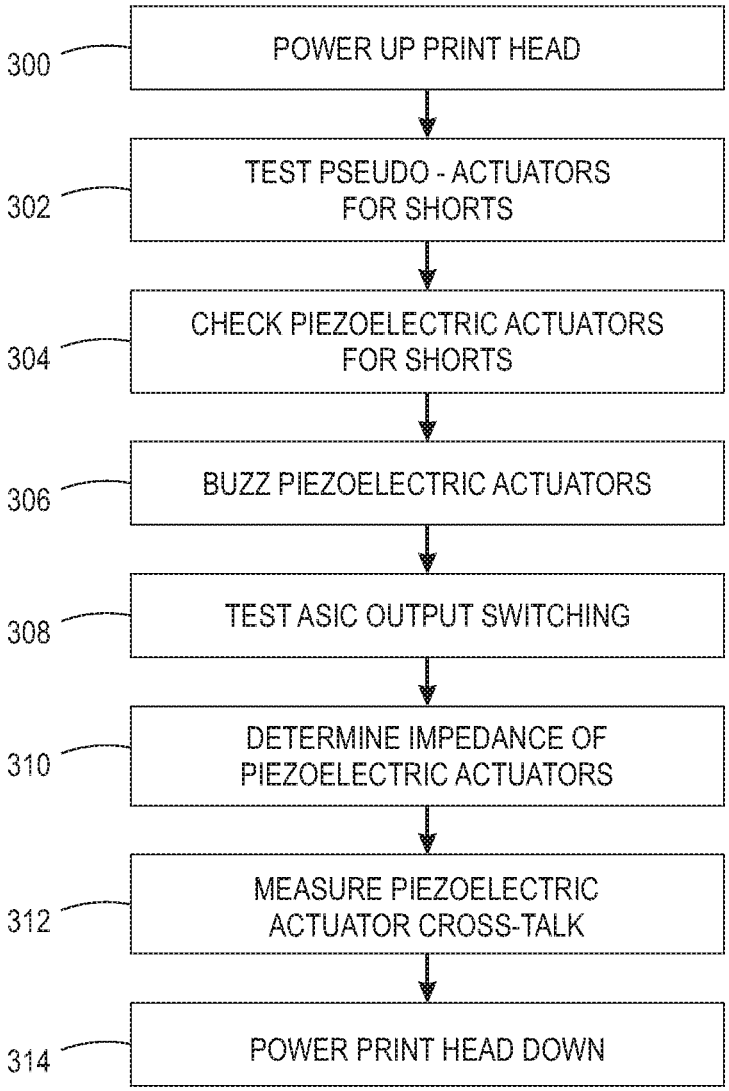
FIG. 3 illustrates a method for measuring an impedance of individual jets in either the print head of FIG. 1 or FIG. 2.

FIG. 3 illustrates a flow chart for a typical impedance measurement test of either one of print heads 100 and 200. The impedance measurement test may include multiple other types of readings, such as current, etc. to determine whether any issues are present in the print head 100 or 200. While the following is referred to as an impedance test, one of ordinary skill in the art will recognize that the individual measurements may be performed without performing the rest of the measurements if one particular issue is being tested.

Initially, in operation 300, the print head 100 or 200 is powered up. The print head 100 or 200 is warmed up if the measurement is at an elevated temperature, and an initial print head temperature is recorded.

In operation 302, pseudo-actuators 110 can be checked for shorts in the same manner as the real jets 108, as described in the next paragraph. Any shorted dummy jets 110 are masked in all further operations.

In operation 304, real jets 108 may be checked for shorts by driving DAC 118 or 210 with a low-amplitude waveform. The waveform amplitude is sufficiently low to avoid any damage to the jet selection circuitry 106 in the event that a jet is shorted. The waveform rail signal amplitude is measured by ADC 122 or 212. The amplitude will be significantly reduced when a shorted jet is selected. Any shorted real jet 108 is masked in all subsequent operations.

In operation 306, the real jets 108 may be "buzzed" using pulses, such as −40V and +20 on the VSS drive rail 112 and VPP drive rail 114 or 202 using pulsed waveforms for a predetermined amount of time, such as 5 seconds, if a buzzing command is specified. Buzzing helps heal nanometer-gap cap opens in the print head 100 or 200.

In operation 308, the electronic selection circuitry 106 output switching is tested. Outputs of the electronic selection circuitry 106 may be toggled between VPP and VSS at a predetermined frequency, such as 2.078 MHz for example, one at a time, with −10V on VSS drive rail 112 and 0V on VPP drive rail 114 or 202. The signal at the VPP drive rail 114 or 202 comes from the electronic selection circuitry 106 output switching current and may be measured by the ADC 122 or 212. This is less accurate than a normal impedance measurement, so it is used primarily for electronic selection circuitry 106 operational verification. Operation 308 may also help heal nanometer-gap can opens in the print head 100 or 200.

In operation 310, an impedance at each frequency of a specified frequency sweep is measured for each piezoelectric actuator 108. As mentioned above, the pseudo-actuator 110 capacitors on the print head 100 or 200 are used as reference capacitors for the impedance measurement to determine an impedance of each piezoelectric actuator 108 for each frequency over the specified frequency sweep. This measurement may take, for example, 2.8 seconds to measure all piezoelectric actuators 108 of a typical print head containing 5500 piezoelectric actuators 108 for each frequency point in the frequency sweep. That is, a first waveform is generated at a first frequency and the electronic selection circuitry 106 switches to one of the various piezoelectric actuators 108 to gather a reading for that piezoelectric actuator 108 at that frequency. After a short settling time, readings from ADC 122 or 212 are collected for a predetermined measurement integration interval, such as 250 μs, for example.

This is repeated for each piezoelectric actuator 108, each pseudo-actuator 110, and interspersed with readings with no jets connected. Performing impedance measurements with no piezoelectric actuators 108 or pseudo-actuators 110 connected allows for a baseline reading. Then a second waveform is generated at a second frequency and the process repeats. This may be performed until the entire desired frequency sweep range has been measured.

Plots of capacitance versus frequency are often easier to view and quicker to glean information from since piezoelectric actuator 108 capacitance usually does not change by orders-of-magnitude across a plot. As such, while the measurement taken is an impedance measurement, since the impedance of a capacitor scales as one over frequency, the controller 116 may report the capacitance that would be required to generate the measured impedance instead of, or in addition to, the impedance measurement itself for each piezoelectric actuator 108. In some embodiments, the controller 116 may report the ADC 122 or 212 readings to another controller or processor located either within or outside of the print head 100 or 200 to perform any needed calculations.

In operation 312, jet cross talk between the piezoelectric actuators 108 may be measured. Individual piezoelectric actuator 108 capacitances are measured at a specific frequency, such as 256 KHz, and then the capacitances are again re-measured in pairs—that is, when two physically-adjacent piezoelectric actuators 108 are connected. Cross-talk is the difference between the sum of two individual readings and a reading of the pair of piezoelectric actuators 108 together. The base electrical coupling between piezoelectric actuators 108, that is the capacitance between traces, must be subtracted from these readings to provide meaningful mechanical or fluidic cross talk measurements.

In operation 314, an ending head temperature is recorded and the print head 100 or 200 is powered down. As will be understood by one skilled in the art, although the features discussed above are shown in a particular order and flow, measurements may be taken in different orders from what is shown in FIG. 3 and discussed above. That is, the operations above are not limited to the particular order shown in FIG. 3.

Throughout any of these measurements, the print head 100 or 200 may perform periodic measurements without any piezoelectric actuator 108 or pseudo-actuators 110 connected to the VPP rail 114 or 202. This allows the print head 100 or 200 to compensate for zero-drift.

Returning to operation 310, the impedance sweeps can confirm both electrical and mechanical operations of ink jets. For example, a poor connection, typically between the piezoelectric actuator 108 and either the diaphragm layer below or a chip-on-flex (COF) contact above may also be identified using the impedance sweep. Such a poor connection would result in real capacitance starting low at a low frequency and dropping to almost zero at approximately 9 MHz. Loss, or an imaginary capacitance, starts high, peaks, and then drops along with the real capacitance at high frequencies. Parallel conductivity may be identified when capacitance starts on the higher side at low frequency, dropping to normal at higher frequencies, while the loss starts high and drops toward zero at higher frequencies. Parallel conductivity is typically caused by ink leaking into the piezoelectric area.

Turning to mechanical connections, a normal shaped capacitance sweep, but scaled down, may indicate that there is a cracked piezoelectric element not connected. Further, an impedance sweep having high capacitance across the frequency range may indicate a cracked or delaminated piezoelectric element. For a cracked or delaminated piezoelectric element, the mechanical resonances are of lower amplitude due to the inefficient electrical-to-mechanical coupling. Subtler piezoelectric cracks that do not show up as high capacitance may still be detected by changes in diaphragm resonances and piezoelectric element's radial resonance.

Mechanical and fluidic resonances show up as peaks in the loss (imaginary) capacitance vs. frequency plots. Dry, pre-ink-filled, impedance sweeps show two primary resonances. The first primary resonance is the diaphragm drum-head resonance, which may be around 900 KHz, for example. The drum-head motion of the diaphragm approximates the motion used in jetting used to eject ink, that is, bending the diaphragm out of and into the body chamber of the print head. Changes in the frequency, width, and/or amplitude of the diaphragm resonance often correlate with changes in jetting performance, that is, the drive voltage required to eject drops.

The second primary resonance is controlled by the piezoelectric element itself, rather than by the diaphragm. The resonance amplitude is generally higher if the piezoelectric element is delaminated from the diaphragm since it is less constrained. Cracks may show up best on this resonance, especially combinations of vertical and horizontal cracks where no remaining piezoelectrical pieces have dimensions large enough to resonate at this second primary resonance. The secondary primary resonance remains largely unaffected by ink-fill, unlike the first primary resonance.

Fluidic resonances are present on filled print heads 100 or 200. With ink, the diaphragm resonance is gone. There is a low-amplitude, but important, low-frequency resonance call a Helmholtz resonance. It is sensitive to the entire single-jet fluid path from the orifice back. There is another resonance, around 550 KHz, for example, where gas bubbles within single-jet features generally shift this resonance higher or lower in frequency depending on the size and location of the bubble. Detecting bubbles by this frequency shift is perhaps the dominant use of the impedance measurement in the print head 100 or 200.

Aspects of the disclosure may operate on particularly created hardware, firmware, digital signal processors, or on a specially programmed computer including a processor operating according to programmed instructions. The terms controller or processor as used herein are intended to include microprocessors, microcomputers, Application Specific Integrated Circuits (ASICs), and dedicated hardware controllers. One or more aspects of the disclosure may be embodied in computer-usable data and computer-executable instructions, such as in one or more program modules, executed by one or more computers (including monitoring modules), or other devices. Generally, program modules include routines, programs, objects, components, data structures, etc. that perform particular tasks or implement particular abstract data types when executed by a processor in a computer or other device. The computer executable instructions may be stored on a computer readable storage medium such as a hard disk, optical disk, removable storage media, solid state memory, Random Access Memory (RAM), etc. As will be appreciated by one of skill in the art, the functionality of the program modules may be combined or distributed as desired in various aspects. In addition, the functionality may be embodied in whole or in part in firmware or hardware equivalents such as integrated circuits, FPGA, and the like. Particular data structures may be used to more effectively implement one or more aspects of the disclosure, and such data structures are contemplated within the scope of computer executable instructions and computer-usable data described herein.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A print head, comprising:

a plurality of piezoelectric actuators;

a pseudo-actuator;

a drive rail;

electronic selection circuitry connected to each of the plurality of piezoelectric actuators, the pseudo-actuator, and the drive rail, the electronic selection circuitry configured to select at least one of the piezoelectric actuators or the pseudo-actuator to connect to the drive rail; and a controller coupled to the drive rail, the controller configured to generate a waveform to drive the drive rail and measure a signal on the drive rail connected to a piezoelectric actuator, a pseudo-actuator, or without any connected piezoelectric actuators or the pseudo-actuator, and using the measured signals to calculate an impedance of a piezoelectric actuator.

2. The print head of claim 1, further comprising a digital-to-analog converter connected to the controller, the digital-to-analog convertor configured to convert a digital signal representing the waveform to drive the drive rail to an analog signal to drive the drive rail.

3. The print head of claim 2, further comprising a low pass filter electrically connected to the digital-to-analog converter.

4. The print head of claim 1, further comprising an analog-to-digital converter configured to receive a signal from the drive rail and output a digital signal representing the signal from the drive rail to determine the impedance.

5. The print head of claim 4, further comprising an amplifier configured to amplify the signal form the drive rail prior to being converted by the analog-to-digital converter.

6. The print head of claim 4, further comprising a digital-to-analog converter configured to receive a digital signal from the controller and output an analog signal; and a combiner to combine the signal from the drive rail and the analog signal to be received at the analog-to-digital converter.

7. The print head of claim 6, further comprising a low pass filter electrically connected to the digital-to-analog converter.

8. A method for measuring an impedance of each of a plurality of piezoelectric actuators of a print head, each piezoelectric actuator connected to electronic selection circuitry of the print head that drives the piezoelectric actuators during a print operation, comprising:

generating a digital waveform at a controller to drive a drive rail of the print head, the drive rail connected to the electronic circuitry of the print head;

converting the digital waveform to an analog waveform to drive the drive rail;

determining the resulting analog waveform of the drive rail;

connecting a pseudo-actuator to the drive-rail through the electronic selection circuitry;

determining an impedance of the pseudo-actuator based on the analog waveform of the drive rail to determine a reference impedance;

connecting one of the piezoelectric actuators to the drive-rail through the electronic selection circuitry; and determining an impedance of each of the piezoelectric actuators based on the reference impedance.

9. The method of claim 8, further comprising determining an impedance of the drive rail when none of the piezoelectric actuators or the pseudo-actuators are connected, wherein determining the impedance of each of the piezoelectric actuators further includes determining the impedance of each of the piezoelectric actuators based on the impedance of the drive rail when none of the piezoelectric actuators or the pseudo-actuators are connected.

10. The method of claim 8, further comprising determining the impedance of each of the plurality of piezoelectric actuators by comparing the determined impedance of each of the piezoelectric actuators to the reference impedance.

11. The method of claim 8, further comprising determining an impedance of the drive rail when disconnected from all the piezoelectric actuators and pseudo-actuators connected to the electronic selection circuitry.

12. The method of claim 8, further comprising applying a direct current bias signal to the drive rail.

13. The method of claim 8, further comprising determining the amplitude of the analog waveform of the drive rail to detect shorted piezoelectric actuators.

14. The method of claim 13, further comprising removing detected shorted piezoelectric actuators from subsequent impedance measurements.

15. The method of claim 8, further comprising determining an impedance of pairs of physically adjacent piezoelectric actuators simultaneously and separately.

16. The method of claim 8, wherein the analog waveform is a periodic waveform and a drive rail of the electronic selection circuitry is measured while a piezoelectric actuator is connected and when a piezoelectric actuator is not connected.

17. The method of claim 8, wherein determining the impedance of the plurality of piezoelectrical actuators includes measuring the impedance by toggling a piezoelectric actuator between connections to two drive power rails and measuring an amplitude and phase of the signal on at least one of the two drive rails.

18. The method of claim 8, further comprising determining an impedance magnitude by toggling a piezoelectric actuator between connections to two drive power rails and measuring current on at least one of the two drive power rails.

19. The method of claim 8, further comprising disabling a majority of field-effect transistors in the print head while determining the impedance of each of the piezoelectric actuators.

* * * * *